United States Patent [19]

Rueb

[11] Patent Number: 4,683,604

[45] Date of Patent: Aug. 4, 1987

[54] TOOTHBRUSH WITH EXCHANGEABLE BRISTLE CARRIER

[76] Inventor: Fritz A. Rueb, Oberfeldstrasse 1-5, D-7869 Schönau, Fed. Rep. of Germany

[21] Appl. No.: 797,240

[22] Filed: Nov. 12, 1985

[30] Foreign Application Priority Data

Mar. 26, 1985 [DE] Fed. Rep. of Germany ..... 3510909

[51] Int. Cl.[4] ..... A46B 9/04

[52] U.S. Cl. ..... 15/176; 15/145

[58] Field of Search ..... 15/167 R, 172, 176, 15/145

[56] References Cited

U.S. PATENT DOCUMENTS 3,088,148 5/1963 Moret ..... 15/145 X 4,461,053 7/1984 Nitzche et al. ..... 15/176 X

FOREIGN PATENT DOCUMENTS 2044089 10/1980 United Kingdom ..... 15/176

*Primary Examiner*—Peter Feldman

*Attorney, Agent, or Firm*—Peter K. Kontler

[57] ABSTRACT

A toothbrush wherein the front end face of the handle has a flat projection which is receivable in a complementary socket in the adjacent end face of the detachable bristle carrier and the projection is integral with an arrowhead-shaped male detent which is detachably snapped into a recess extending from the socket into that surface of the carrier from which the bristles extend.

19 Claims, 6 Drawing Figures

TOOTHBRUSH WITH EXCHANGEABLE BRISTLE CARRIER

BACKGROUND OF THE INVENTION

The present invention relates to toothbrushes in general, and more particularly to improvements in composite toothbrushes of the type wherein the bristle carrying member (hereinafter called carrier or bristle carrier for short) is separable from the handgrip (hereinafter called handle).

It is already known to assemble a toothbrush from two separable pieces one of which constitutes the handle and the other of which carries the bristles. Such pieces have confronting end faces and the end face of the carrier has a socket for a projection which extends from the end face of the handle. The socket is surrounded by the material of the carrier at all sides except at the end face of the carrier. An advantage of a composite toothbrush is that the handle can be reused when the wear upon the bristles has progressed to an extent such as to warrant dispensing with the carrier and its replacement by a fresh carrier. Frequent replacement of carriers with unsatisfactory or worn bristles is desirable for hygienic as well as for medical reasons. Furthermore, it is possible to utilize an elaborate, decorative and reasonably expensive handle because it need not be discarded with the bristle carrier.

Published European patent application Ser. No. 0 083 787 discloses a composite toothbrush which employs a metallic handle. The rear end of the handle is embedded in a synthetic plastic knob. The knob and the handle are secured to each other with a force which suffices to allow for safe manipulation of the handle when the toothbrush is in use. The front end portion of the handle extends into a socket of the bristle carrier and is held therein by friction and/or by clamping action. Mere frictional and/or clamping engagement is often insufficient to prevent undesirable separation of the bristle carrier from the handle when the toothbrush is in actual use. For example, if the front end portion of the handle is held in the socket merely by friction, the magnitude of friction tends to decrease in response to repeated use of the toothbrush and attendant movements of the front end portion of the handle relative to the carrier. Since the handle is made of a metallic material, its front end is likely to hurt or even injure the mouth of the user in response to undesired segregation of the bristle carrier from the handle.

German Utility Model No. 84 28 969 discloses a different coupling between the front end portion of the handle and the bristle carrier of a two-piece toothbrush. The coupling includes a dovetailed male portion at the front end of the handle and a complementary socket in the bristle carrier. In addition, the German Utility Model discloses a small projection which can enter a recess to enhance the reliability of the coupling which is constituted by the male member and the socket. The bristle carrier has a substantially U-shaped outline and its legs flank the male coupling member. Such design is unsatisfactory because the bristle carrier is relatively weak and is likely to expand so that the male coupling member can be extracted from the space between the legs with attendant undesirable separation of the bristle carrier from the handle. Moreover, the aforementioned projection and the recess therefor do not contribute appreciably to reliability of the connection between the handle and the bristle carrier.

OBJECTS AND SUMMARY OF THE INVENTION

An object of the invention is to provide a novel and improved composite toothbrush wherein the coupling between the front end portion of the handle and the bristle carrier is designed in such a way that the user is highly unlikely to accidentally separate the bristle carrier while the toothbrush is in use.

Another object of the invention is to provide a novel and improved bristle carrier for use in the composite toothbrush.

A further object of the invention is to provide a novel and improved handle for use in the composite toothbrush.

An additional object of the invention is to provide a novel and improved coupling between the handle and the bristle carrier of the above outlined composite toothbrush.

Still another object of the invention is to provide a composite toothbrush wherein the bristle carrier can be readily separated from the handle when such separation is desired by the user.

A further object of the invention is to provide a composite toothbrush with a simple coupling which can be readily manipulated by children, grownups, elder citizens and/or patients in hospitals, sanitaria and similar institutions.

Another object of the invention is to provide a composite toothbrush wherein the establishment of a proper connection between the handle and the bristle carrier can be detected with naked eye.

Another object of the invention is to provide a composite toothbrush which is of eye-pleasing appearance, which can be furnished with any desired number of identical or different bristle carriers, and whose handle can be reused as often as desired.

The invention is embodied in a composite toothbrush which comprises a handgrip member (handle), a bristle carrying member (bristle carrier) and a novel and improved coupling between such members. The members have confronting end faces and lateral surfaces which are adjacent to the respective end faces. The end face of one of the members has a socket which is remote from the respective lateral surface, and the coupling comprises a female detent element which is provided on the one member and has a recess in communication with the socket and extending toward the respective lateral surface as well as all the way to the respective end face. The other member has a projection which extends from the respective end face and into the socket, and the coupling further comprises a male detent element which is provided on the other member and formlockingly extends into the recess to maintain the projection in the socket. In accordance with a presently preferred embodiment of the toothbrush, the socket is provided in the end face of the bristle carrying member. The recess preferably extends into the lateral surface of the one member and the projection preferably fills or at least substantially fills the socket. Furthermore, the male detent element preferably fills or substantially fills the recess so as to prevent the accumulation of contaminants in the interior of the one member.

The projection is insertable into and extractible from the socket in a predetermined direction, namely in the longitudinal direction of the handgrip member, and the recess extends transversely of such direction and toward or all the way into the lateral surface of the one member. The recess has a tapering portion whose width (as considered transversely of the aforementioned direction) increases toward the end face of the one member. The male detent element is formed with a substantially arrowhead-shaped portion which is received in the tapering portion of the recess, and the male detent element is preferably provided with at least one undercut which is adjacent to the maximum-width portion of the male detent element. The female detent element is preferably formed with one or more protuberances, one for each undercut of the male detent element and each extending into the respective undercut when the male and female detent elements are properly assembled to maintain the projection of the other member in the socket of the one member.

The male detent element is preferably formed with a pair of elongated first flanks which make an acute angle with the aforementioned direction, and with a pair of second flanks which are located in the undercuts and make relatively large oblique angles with the respective first flanks. The first flanks converge toward each other in a direction away from the end face of the other member and the composite toothbrush has a central symmetry plane which extends in the direction of insertion or extraction of the projection into and from the socket and halves the socket, the recess, the projection and the detent elements. One first flank and one second flank is disposed at one side and the other first flank as well as the other second flank is disposed at the other side of the symmetry plane. The two undercuts are also disposed at the opposite sides of such symmetry plane. The female detent element is preferably provided with facets which flank selected portions of the recess and abut against the adjacent flanks of the male detent element. The latter is preferably provided with a rounded tip which is remote from the end face of the other member and extends into the deepmost portion of the recess. The bristles which are anchored in the bristle carrying member preferably extend from the lateral surface of such member.

The bristle carrying member preferably includes a wall which flanks the socket and the recess opposite the lateral surface of the bristle carrying member and extends all the way to the end face of the bristle carrying member.

The male detent element has a surface which is preferably flush with the lateral surface of the one member when the male detent element extends into the recess of the female detent element.

The projection is or can be integral with the male detent element, and the projection as well as the male detent element are preferably integral with the other member. For example, the projection, the male detent element and the other member can consist of a synthetic plastic material. Such parts can constitute a one-piece extruded synthetic plastic article.

At least a portion of the male detent element is preferably provided with first visually detectable indicia, and at least a portion of the female detent element is preferably provided with different second visually detectable indicia. Such indicia can include different pigments. The provision of indicia is desirable and advantageous because they facilitate proper orientation of the male and female detent elements preparatory to introduction of the male detent element into the recess. The projection of the other member is preferably formed with a substantially flat side which faces the recess in the female detent element when the latter receives the male detent element, and the aforementioned flanks of the male detent element are preferably normal or substantially normal to such side of the projection.

It is also possible to provide the female detent element on that member which carries the projection and to provide the male detent element on that member which is provided with the socket.

The novel features which are considered as characteristic of the invention are set forth in particular in the appended claims. The improved toothbrush itself, however, both as to its construction and the mode of coupling and separating the two members from each other, together with additional features and advantages thereof, will be best understood upon perusal of the following detailed description of certain specific embodiments with reference to the accompanying drawing.

DESCRIPTION OF THE PREFERRED EMBODIMENTS

Figure 1:
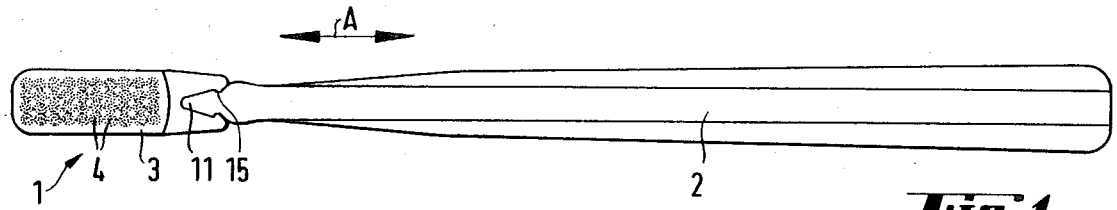
FIG. 1 is a schematic plan view of a toothbrush which embodies the invention, the male detent element being fully received in the recess of the female detent element.

Referring first to FIG. 1, there is shown a composite toothbrush 1 which comprises a handgrip member or handle 2 and a bristle carrying member or bristle carrier 3. That end face (5) of the carrier 3 which faces the handle 2 has a flat but wide socket 7 which receives a flat tongue-like projection 8 extending forwardly from the end face 21 of the handle 2. The socket 7 is substantially completely surrounded by the material of the carrier 3 except at its inlet 6 in the end face 5. When the handle 2 is properly assembled with the carrier 3, the projection 8 at least substantially fills the socket 7 so as to reduce the likelihood of accumulation of contaminants in the carrier 3. The socket 7 is remote from that lateral surface (23) of the carrier 3 from which the bunches or bundles of bristles 4 extend.

The socket 7 is flanked by a solid wall 19 which forms a integral part of the carrier 3 and extends all the way to the end face 5, and by a second wall 12 which extends between the socket 7 and the lateral surface 23 and a portion (10) of which constitutes a female detent element having a recess 9 communicating with the socket 7 and extending all the way to the lateral surface 23 as well as to the end face 5 of the carrier 3.

The female detent element 10 cooperates with a male detent element 11 which is a pallet extending from the flat upper side 29 of the projection 8 and being formlockingly received in the recess 9 when the detent elements 10 and 11 are properly assembled in a manner as shown in FIG. 1 to thereby prevent accidental separation of the carrier 3 from the respective end portion of the handle 2. The male detent element 11 includes a substantially arrowhead-shaped front portion having a rounded tip 13 which is remote from the end face 21 on the handle 2 and fits snugly into the deepmost portion 18 of the recess 18. The arrowhead-shaped portion of the male detent element 11 is provided with two mutually inclined elongated flanks 14 which converge toward each other in a direction away from the end face 21 and make an acute angle. Those end portions of the flanks 14 which are nearer to the end face 21 are adjacent to relatively short second or additional flanks 27 which are provided in shallow undercuts 16 of the male detent element 11. Each flank 27 is disposed between one of the elongated flanks 14 and the end face 21 of the handle 2. The female detent element 10 has complementary facets 17, which contact the respective flanks 14, and 28 which contact the respective flanks 27 when the male detent element 11 is received in the recess 9. The facets 28 are provided on small tooth-shaped protuberances 26 of the female detent element 10.

Figure 6:
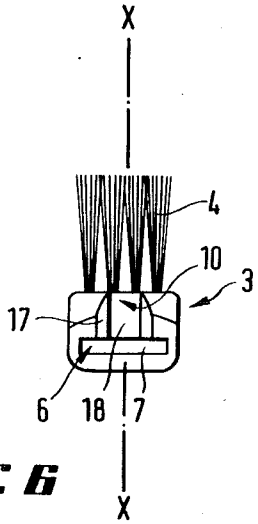
FIG. 6 is an end elevational view of the bristle carrying member as seen from the right-hand side of FIG. 2.
Figure 3:
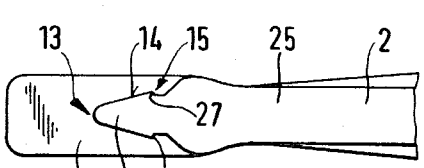
FIG. 3 is an enlarged fragmentary plan view of the handgrip member and shows the projection and the male detent element as integral parts of the handgrip member.

FIG. 6 shows a symmetry plane X—X which extends in the longitudinal direction of the handle 2 midway between the pairs of flanks 14, 27 and facets 17, 28. The double-headed arrow A indicates in FIG. 1 the directions in which the carrier 3 can be moved by hand in order to forcibly extract the male detent element 11 from the recess 9 of the female detent element 10 or to reinsert the element 11 into the recess 9 or into the recess of a different carrier 3.

The undercuts 16 of the male detent element 11 are adjacent to the maximum-width portion 15 of such element, as measured transversely of the direction indicated by the arrow A. Such portion 15 of maximum width is somewhat closer to the end face 21 of the handle 2 than to the rounded tip 13 of the male detent element 11. The flanks 14 and 27 of the male detent element 11 are preferably normal or substantially normal to the flat upper side 29 of the projection 8.

It is possible to modify the carrier 3 by providing it with a recess 9 which does not extend all the way to the lateral surface 23. However, the construction which is shown in the drawing is preferred at this time because the portions of the wall 12 at the opposite sides of the symmetry plane X—X exhibit a more pronounced elasticity if the recess extends all the way into the lateral surface 23 so that it is easier to introduce the male detent element 11 into or to extract it from the recess 9 of the female detent element 10.

The angle between the mutually inclined elongated flanks 14 of the male detent element 11 is preferably smaller than the angle between the shorter flanks 27 as well as the angle between a flank 14 and the adjacent flank 27.

The feature that the projection 8 fills the socket 7 and the male detent element 11 fills the recess 9 of the female detent element 10 is desirable and advantageous because this reduces the likelihood of wobbling of the handle 2 relative to the carrier 3 and/or vice versa when the toothbrush 1 is in actual use. Moreover, the formlocking connection between the detent elements 10 and 11 ensures the establishment of a more reliable coupling between the parts 2 and 3.

The aforediscussed orientation of the flanks 14, 27 and facets 17, 28 with reference to the symmetry plane X—X is desirable and advantageous because this ensures that the forces which develop when the toothbrush 1 is in use and tend to separate the carrier 3 from the handle 2 are uniformly distributed along the surfaces which flank the recess 9 and along the flanks of the male detent element 11.

Figure 5:
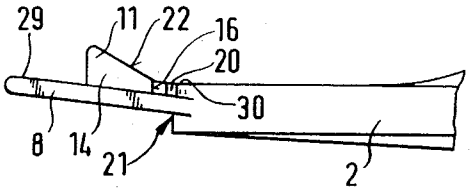
FIG. 5 is a side elevational view of that portion of the handgrip member which is shown in FIG. 3.
Figure 2:
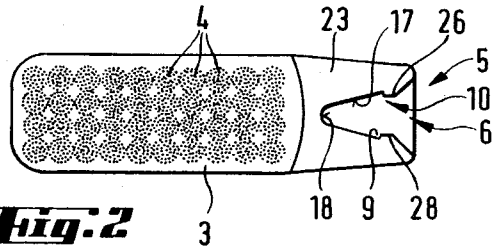
FIG. 2 is an enlarged plan view of the bristle carrying member.
Figure 4:
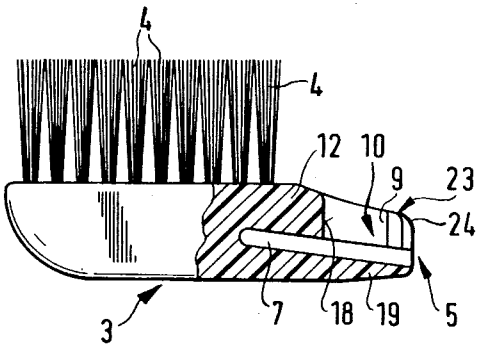
FIG. 4 is an enlarged side elevational view of the bristle carrying member, with a portion of such member broken away to reveal the socket and the recess of the female detent element.

The placing of the recess 9 at that side of the socket 7 which faces away from the uninterrupted wall 19 of the carrier 3 is desirable and advantageous because the wall 19 can take up substantial stresses when the toothbrush 1 is in use and the user applies forces which tend to flex the projection 8 in a counterclockwise direction, as viewed in FIG. 5. The foremost portion of the projection 8 is safely anchored in the deepmost portion of the socket 7, and that portion of the projection 8 which is adjacent to the end face 21 of the handle 2 is in contact with the part of the wall 19 which is located opposite the recess 9 to thus ensure that the bending stresses and the resulting moments can be safely taken up when the toothbrush is in use. The distance between the rearmost portion 20 and the tip 13 of the male detent element 11 can equal or approximate half the length of the projection 8, as considered in the direction of the arrow A. It has been found that, when the improved toothbrush is in use, the element 11 continues to fill the recess 9 and the projection 8 continues to fill the socket 7 so that the external surfaces of the parts 8, 11 and/or the surfaces surrounding the socket 7 and recess 9 cannot accumulate contaminants such as remnants of food, remnants of toothpaste or the like.

The height of the male detent element 11, as measured at right angles to the side 29 of the projection 8, increases in a direction from its rear end 20 toward the tip 13. This can be readily seen in FIG. 5. The surface 22 of the detent element 11 is preferably flush with the adjacent portion of the lateral surface 23 of the carrier 3 when the handle 2 is properly assembled with the carrier. This also reduces the likelihood of accumulation of contaminants in the carrier 3 as well as the likelihood of injury to the user of the toothbrush.

If the user wishes to replace the carrier 3 with a different carrier or to clean the projection 8 and the male detent element 11 as well as the surfaces surrounding the socket 7 and the recess 9, the carrier is pulled in a direction to the left, as viewed in FIG. 1, so that the male detent element 11 is forcibly extracted from the recess 9. At such time, the protuberances 26 of the female detent element 10 yield slightly so that they can be bypassed by the flanks 27 of the male detent element 11 while the latter moves in a direction to the right, as viewed in FIG. 1 or while the carrier 3 moves in a direction to the left, as viewed in FIG. 1. The mutual inclination of facets 28 and flanks 27 will determine the magnitude of force which is necessary to extract the male detent element 11 from the recess 9. The magnitude of such force is all determined by rigidity or elasticity of the material of the carrier 3 as well as by the height of protuberances 26 of the female detent element 10, i.e., of the wall 12 of the carrier 3.

When the user thereupon decides to reattach the carrier 3 to the handle 2, or to connect the handle with a different carrier 3, the male detent element 11 is caused to penetrate and shap into the recess 9 whereby the entry of the male detent element into the female element 10 is readily detectable because the protuberances 26 snap into the respective undercuts 16 with an audible click. The hands of the manipulator also detect complete penetration of the male detent element 11 into the recess 9 of the female detent element 10. The relatively large projection 8 establishes a pronounced surface-to-surface contact with the carrier 3, and the detent elements 10, 11 constitute a simple but highly reliable coupling which releasably holds the carrier 3 in engagement with the front end portion of the handle 2 until and unless the user decides to separate the carrier from the projection 8 and male detent element 11. The magnitude of force with which the detent elements 10, 11 hold the projection 8 in the socket 7 can be readily selected by the maker of the toothbrush by proper selection of the inclination of flanks 27 and facets 28 as well as of the height of protuberances 26 and the material of the carrier 3.

It is also within the purview of the invention to provide the female detent element 10 on the handle 2 and to provide the male detent element 11 on the carrier 3. However, the illustrated construction of the improved toothbrush 1 is preferred at this time for manufacturing reasons. The handle 2 is preferably made of a suitable synthetic plastic material. The projection 8 and the male detent element 11 of the illustrated toothbrush 1 are integral parts of the handle 2. The parts 2, 8 and 11 can constitute a one-piece article which is mass-produced in an extruding or other suitable plastic processing machine. The material of the carrier 3 may but need not be identical with the material of the handle 2. The manner in which the bristles 4 are embedded in the material of the carrier 3 forms no part of the present invention.

An important advantage of the improved toothbrush is that the coupling including the detent elements 10 and 11 solves several apparently conflicting problems, namely reliable retention of the projection 8 in the socket 7 as well as convenient and simple separation of the carrier 3 from the handle 2 when such separation is desirable or necessary. The projection 8 is completely confined in the socket 7 (i.e., in the carrier 3) when the male detent element 11 is properly received in the recess 9 of the female detent element 10. The detent element 11 is formlockingly held in the recess 9 with a selected force against extraction of the projection 8 from the socket 7 until and unless the protuberances 26 are moved apart in directions away from the symmetry plane X—X so that the distance between such protuberances matches the maximum width (at 15) of the arrowhead-shaped portion of the male detent element 11.

Another important advantage of the improved coupling including the detent elements 10 and 11 is that the arrowhead-shaped portion of the element 11 is loose in the recess 9 until the protuberances 26 snap into the respective undercuts 16. This ensures that even a superficial or clumsy person immediately detects that the carrier 3 is not properly connected to the handle 2 and can complete the attachment of the carrier 3 to the handle by the simple expedient of exerting upon the carrier 3 a force which suffices to ensure that the entire detent element 11 is received in the recess 9. This feature is attributable to the relatively small acute angle between the elongated flanks 14 of the detent element 11. The provision of flanks 27 which make a relatively large angle ensures that the extraction of detent element 11 from the recess 9 necessitates the application of a reasonable force, i.e., that the carrier 3 cannot be accidentally separated from the handle 2. In all instances, the inclination and dimensions of the flanks 14, 27 and of the corresponding facets 17, 28 will be selected in such a way that the carrier 3 is reliably held on the handle 2 when the improved toothbrush is in actual use but that it is still possible to rapidly detach the carrier 3 when the need for such detachment arises. As mentioned above, the recess 9 preferably extends all the way into the lateral surface 23 of the carrier 3 to thus ensure that the protuberances 26 can readily move apart in response to the application of a force which is necessary to separate the carrier 3 from the handle 2. Furthermore, such dimensioning of the recess 9 reduces the likelihood of damaging the carrier 3 and/or the projection 8 and/or the male detent element 11 during attachment of the carrier to the handle by a clumsy person.

The coupling including the detent elements 10 and 11 can be simplified by making one side of the detent element 11 flat, i.e., by providing such detent element with a single flank 14 and with a single flank 27. However, the provision of a pair of mirror symmetrical flanks 14 and of a pair of mirror symmetrical flanks 27 is preferred because this ensures a more uniform distribution of forces during attachment of the carrier 3 to or its detachment from the handle 2. Uniform distribution of forces (with reference to the symmetry plane X—X) is also important When the toothbrush is in use. The provision of a rounded tip 13 simplifies and facilitates the introduction of male detent element 11 into the recess 9.

That portion of the lateral surface 23 which is adjacent to the rear end 20 of the male detent element 11 preferably carries indicia at 24 (for example a first pigment) which are different from the indicia 30 on the lateral surface 25 of the handle 2 in the region of the end face 21. This renders it possible to rapidly orient the carrier 3 in an optimum position with reference to the handle 2 preparatory to introduction of the male detent element 11 into the recess 9 of the female detent element 10. Of course, it is equally possible to impart to the material of the entire handle 2 a first color and to impart to the entire carrier 3 a different second color or to make both parts of a single color but having different hues. The provision of indicia in the form of arrows, dots, or the like is also contemplated. All that counts is to provide some indicia which can be readily observed by the manipulator so as to facilitate her or his task of introducing the detent element 11 into the recess 9.

As mentioned above, the handle 2 can be reused as often as desired so that it is worthwhile to make the handle of a rather expensive or reasonably expensive material. The improved toothbrush can be furnished with a set of carriers 3 each of which has different bristles. For example, a first carrier can be provided with several bundles or bunches of relatively soft bristles, another carrier can have bristles which are reasonably stiff, and a further carrier can be provided with bristles which are capable of resisting rather pronounced bending stresses.

Without further analysis, the foregoing will so fully reveal the gist of the present invention that others can, by applying current knowledge, readily adapt it to various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A composite toothbrush comprising a handgrip member; a bristle carrying member, said members having confronting end faces and lateral surfaces adjacent to the respective end faces, the end face of one of said members having a socket remote from the respective lateral surface; a female detent element provided on said one member and having a recess communicating with said socket and extending toward the respective lateral surface as well as all the way to the respective end face; a projection provided on the other of said members and extending from the respective end face into said socket, said projection being insertable into and extractible from said socket in a predetermined direction and the width of a portion of said recess, as considered transversely of said direction, increasing toward the end face of said one member; and a male detent element provided on said other member and being formlockingly received in said recess to maintain said projection in said socket, said male detent element at least substantially filling said recess and having at least one undercut, said female detent element having a protuberance in said undercut, said male detent element having a portion of maximum width, as considered in said direction, and said undercut being adjacent to said portion of maximum width, said male detent element further having a first flank which makes an acute angle with said direction and a second flank located in said undercut and making an oblique angle with said first flank.

2. A composite toothbrush comprising a handgrip member; a bristle carrying member, said members having confronting end faces and lateral surfaces adjacent to the respective end faces, the end face of one of said members having a socket remote from the respective lateral surface; a female detent element provided on said one member and having a recess communicating with said socket and extending toward the respective lateral surface as well as all the way to the respective end face; a projection provided on the other of said members and extending from the respective end face into said socket, said projection being insertable into and extractible from said socket in a predetermined direction and the width of a portion of said recess, as considered transversely of said direction, increasing toward the end face of said one member; and a male detent element provided on said other member and being formlockingly received in said recess to maintain said projection in said socket, said male detent element having a portion remote from the end face of said other member and having two elongated flanks which converge toward each other in a direction away from the respective end face, said male detent element further having two undercuts each disposed between one of said flanks and the respective end face and said female detent element having protuberances which extend into the undercuts of said male detent element.

3. The toothbrush of claim 2, wherein said socket is provided in the end face of said bristle carrying member.

4. The toothbrush of claim 2, wherein said recess extends into the lateral surface of said one member, said projection at least substantially fills said socket, and said male detent element at least substantially fills said recess.

5. The toothbrush of claim 2, wherein said male detent element at least substantially fills said recess.

6. The toothbrush of claim 2, wherein said recess extends transversely of said direction into the lateral surface of said one member.

7. The toothbrush of claim 2, wherein said elongated flanks make an acute angle and said portion of said male detent element has two additional flanks provided in said undercuts and making oblique angles with the respective elongated flanks.

8. The toothbrush of claim 7, wherein said members have a common symmetry plane extending in said predetermined direction, the elongated flanks of said portion of said male detent element and said additional flanks being mirror symmetrical to each other with reference to said plane, said female detent element having facets which contact the flanks of said male detent element.

9. The toothbrush of claim 2, wherein said male detent element has a rounded tip which is remote from the end face of said other member.

10. The toothbrush of claim 2, wherein said socket is provided in said bristle carrying member and further comprising bristles anchored in and extending from the lateral surface of said bristle carrying member.

11. The toothbrush of claim 2, wherein said socket is provided in said bristle carrying member and said bristle carrying member has a wall flanking said socket and said recess opposite the lateral surface of said bristle carrying member and extending all the way to the end face of said bristle carrying member.

12. The toothbrush of claim 2, wherein said recess extends into the lateral surface of said one member and said male detent element has a surface which is flush with the lateral surface of said one member.

13. The toothbrush of claim 2, wherein said projection is integral with said male detent element.

14. The toothbrush of claim 2, wherein said projection and said male detent element are integral with said other member.

15. The toothbrush of claim 14, wherein said projection, said male detent element and said one member consist of a synthetic plastic material.

16. The toothbrush of claim 2, wherein said other member, said projection and said male detent element together constitute a one-piece extruded synthetic plastic article.

17. The toothbrush of claim 2, wherein at least a portion of said male detent element is provided with first visually detectable indicia and at least a portion of said female detent element is provided with different second visually detectable indicia.

18. The toothbrush of claim 17, wherein said indicia include pigments.

19. The toothbrush of claim 2, wherein said projection has a side facing said recess and said male detent element has a plurality of facets which are at least substantially normal to said side of said projection.

* * * * *